US006509726B1

(12) United States Patent
Roh

(10) Patent No.: US 6,509,726 B1
(45) Date of Patent: Jan. 21, 2003

(54) AMPLIFIER FOR A BANDGAP REFERENCE CIRCUIT HAVING A BUILT-IN STARTUP CIRCUIT

(75) Inventor: Jeongjin Roh, Austin, TX (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/918,351

(22) Filed: Jul. 30, 2001

(51) Int. Cl.[7] ..... G05F 3/16
(52) U.S. Cl. ..... 323/313; 323/314
(58) Field of Search ..... 323/312, 313, 323/314; 327/538, 539

(56) References Cited

U.S. PATENT DOCUMENTS 4,857,823 A * 8/1989 Bitting ..... 323/314
5,610,506 A * 3/1997 McIntyre ..... 323/313
6,150,872 A * 11/2000 McNeill et al. ..... 327/539
6,232,829 B1 * 5/2001 Dow ..... 327/539
6,313,615 B1 * 11/2001 Fayneh et al. ..... 323/281

* cited by examiner

*Primary Examiner*—Adolf Deneke Barhane
(74) *Attorney, Agent, or Firm*—Trop, Pruner & Hu, P.C.

(57) ABSTRACT

A bandgap reference circuit includes at least one transistor, an amplifier and a start-up circuit. The amplifier is coupled to the transistor(s) to establish a bandgap reference voltage. The start-up circuit, in response to the bandgap reference circuit powering up, isolates an output terminal of the amplifier from at least one input terminal of the amplifier and supplies power to the transistor(s) via the output terminal.

25 Claims, 4 Drawing Sheets

AMPLIFIER FOR A BANDGAP REFERENCE CIRCUIT HAVING A BUILT-IN STARTUP CIRCUIT

BACKGROUND

The invention generally relates to powering up a bandgap reference circuit.

Bandgap reference circuits are typically chosen due to their ability to produce reference voltages that vary little with temperature. For example, FIG. 1 depicts a typical bandgap reference circuit 10. The circuit 10 includes a high gain operational amplifier 12, three resistors 14, 16 and 17 and two PEP bipolar junction transistors (BATS) 18 and 20.

Regarding the specific structure of the bandgap reference circuit 10, the output terminal of the amplifier 12 provides a bandgap reference voltage (called "Vbg"). Each BJT 18 and 20 has its base terminal coupled to its collector terminal, and the collector terminal of each BJT 18, 20 is coupled to ground. The emitter terminal of the BJT 18 is coupled to the output terminal of the amplifier 12 through the resistors 14 and 17. The emitter terminal of the BJT 20 is coupled to the output terminal of the amplifier 12 through the resistor 16. The inverting input terminal of the amplifier 12 is coupled to a node between the resistors 14 and 17, and the non-inverting input terminal of the amplifier 12 is coupled to the emitter terminal of the BJT 20. As depicted in FIG. 1, a current called I1 flows through the emitter-collector path of the BJT 18, and a current called I2 flows through the emitter-collector path of the BJT 20.

Due to the high gain of the amplifier 12, the non-inverting and inverting input terminals of the amplifier 12 are approximately equal to establish the following relationship:

$$Vbe1+I1*R3=Vbe2, \qquad \text{Equation 1}$$

where "Vbe1" and "Vbe2" are the base-emitter voltages of the BATS 18 and 20, respectively, and "R3" represents the resistance of the resistor 17. From this relationship, the I1 current may be calculated as described below:

$$I1=(Vbe2-Vbe1)/R3 \qquad \text{Equation 2}$$

If it is assumed that the resistors 14 and 16 have the same resistances, then the I2 current equals the I1 current, and from Equations 1 and 2, the Vbg bandgap reference voltage may be calculated as described below:

$$Vbg=Vbe1+(1+R1/R3)*(Vt*\ln(n)), \qquad \text{Equation 3}$$

where "Vt" is the thermal voltage that is equal to approximately 25.875 mV at room temperature, "n" is the ratio of the areas of the BATS 18 and 20 and "R1" is the resistance of the resistor 14, 16.

In Equation 3, the Vbel voltage has a negative proportional-to-absolute-temperature (PTAT) coefficient, and the second term on the right-hand side of the equation has a positive PTAT. Therefore, by controlling the ratio of the resistances 14 and 17 and the ratio n, the Vbg bandgap reference voltage may have very little dependency on temperature.

However, a potential difficulty with the bandgap reference circuit 10 is that there are two possible solutions for Vbg in Equation 3. Thus, the Vbg bandgap reference voltage may be either a well-controlled voltage (1.25 volts, for example) as desired, but the Vbg voltage may also be zero volts. For example, a scenario in which the Vbg bandgap reference voltage is zero volts may occur due to the circuit 10 being powered down, a state of the circuit 10 in which the Vbg bandgap reference voltage is zero volts. When the bandgap reference circuit 10 powers up and transitions into its normal mode of operation, however, the Vbg bandgap reference voltage may not change from zero volts.

Referring to FIG. 2, to prevent the above-described scenario from occurring, a start-up circuit, such as a start-up circuit 30 that is depicted in FIG. 2, typically accompanies the bandgap reference circuit 10 and is used for the purpose of ensuring that the Vbg bandgap reference voltage indicates the desired solution to Equation 3. The start-up circuit 30 may include several resistors, such as an explicit resistor 32 and n-channel metal-oxide-semiconductor field-effect-transistors (NMOSFETs) 34, 36 and 38 that are configured as resistors. These resistors form a resistor divider to scale down a supply voltage (called Vcc) to provide a voltage and a current to the emitter terminal of the BJT 20. Due to this arrangement, when the bandgap reference circuit 10 powers up, current flows through the emitter-collector path of the BJT 20 to produce a nonzero voltage at the non-inverting input terminal of the amplifier 12. This voltage, in turn, produces a nonzero voltage at the inverting input terminal of the amplifier 12 if the input voltage swing of the amplifier 12 is sufficient. Thus, non-zero voltages and currents that are produced by the start-up circuit 30 should ideally prevent the Vbg bandgap reference voltage from being zero volts after power up.

There are potential drawbacks to the start-up circuit 30. For example, the amplifier 12 may not operate correctly if the Vbe2 voltage is too low, thereby causing the Vbg bandgap reference voltage to still come up at zero volts. Furthermore, the start-up circuit 30 consumes current during the normal mode of operation of the bandgap reference circuit 10, after the power-up has been completed. This may be disadvantageous if the bandgap reference circuit 10 is used in, for example, a wireless or portable product that requires low power operation.

Thus, there is a continuing need for an arrangement that addresses one or more of the problems that are stated above.

DETAILED DESCRIPTION

Figure 1:
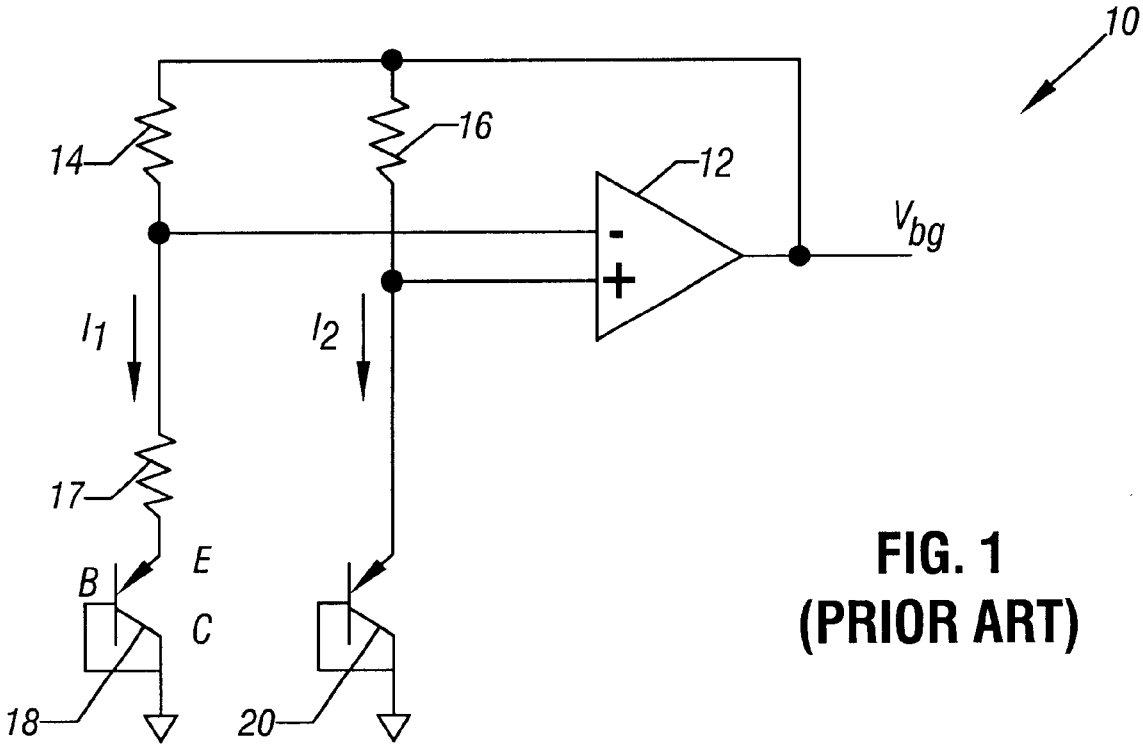
FIG. 1 (PRIOR ART)
FIG. 1 is a schematic diagram of a bandgap reference circuit of the prior art.
Figure 2:
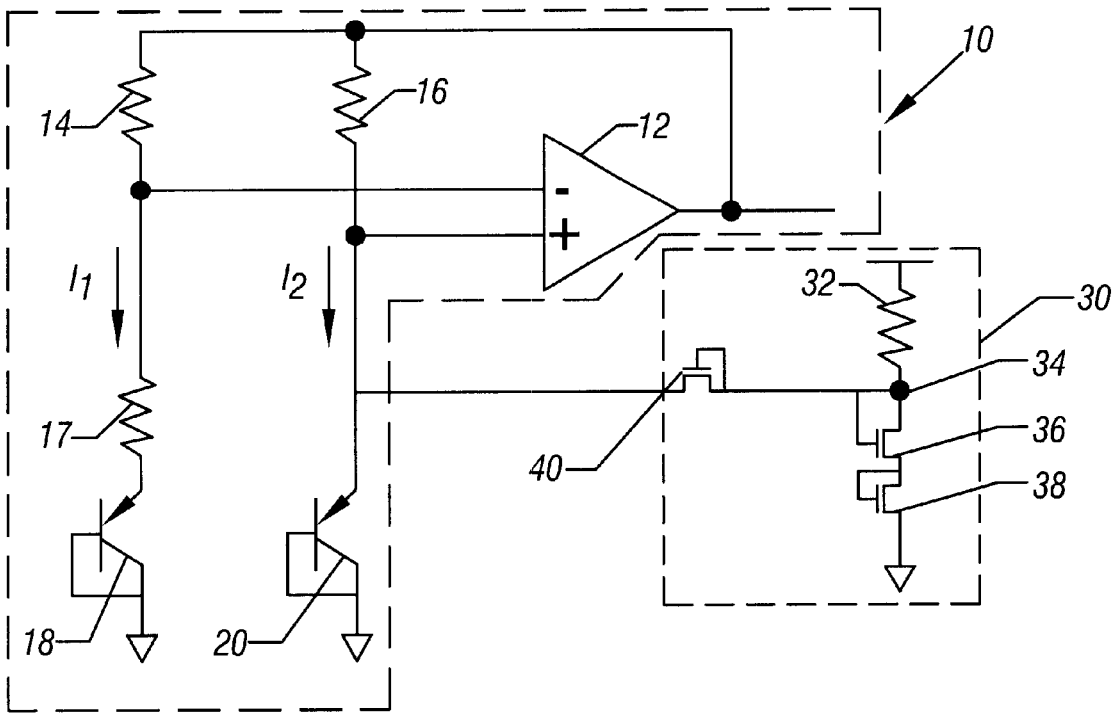
FIG. 2 (PRIOR ART)
FIG. 2 is a schematic diagram of the bandgap reference circuit of FIG. 1 with the addition of a start-up circuit of the prior art.
Figure 3:
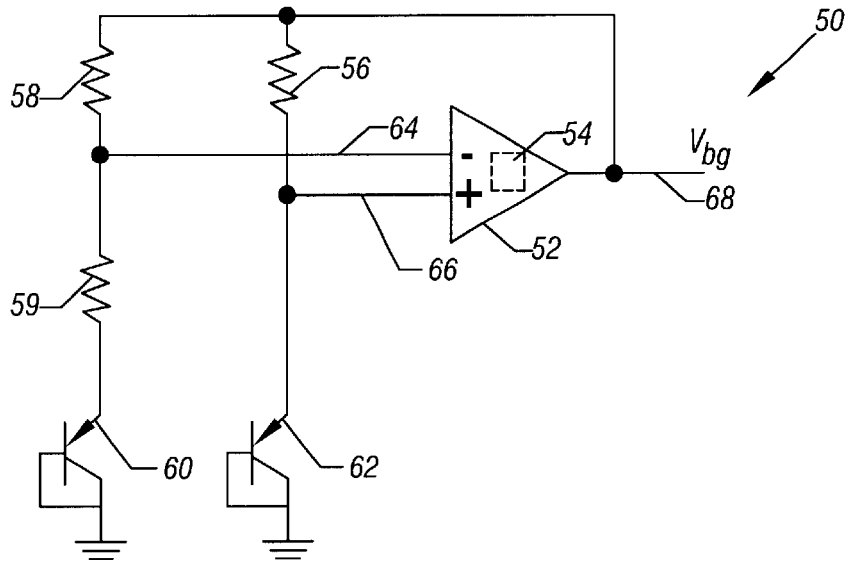
FIG. 3 is a schematic diagram of a bandgap reference circuit according to an embodiment of the invention.

Referring to FIG. 3, an embodiment 50 of a bandgap voltage reference circuit in accordance with the invention includes an amplifier 52 (an operational amplifier (op amp"), for example) that has a built-in start-up circuit 54 to, in response to the bandgap reference circuit 50 powering up, a bandgap reference voltage (called Vbg) that is furnished by the circuit 50 to a predetermined level. More specifically, in response to the bandgap reference circuit 50 (and amplifier 52) powering up, the start-up circuit 54 isolates inverting 64 and non-inverting 66 input terminals of the amplifier 52 from the amplifier's output terminal 68, a terminal that provides the Vbg bandgap reference voltage. During this period of isolation, the start-up circuit 54 furnishes a current to the output terminal 68 to provide power to the circuitry of the bandgap reference circuit 50 to cause the Vbg bandgap reference voltage to come up at the appropriate level.

After the bandgap reference circuit 50 powers up, the start-up circuit 54 is disabled to permit communication between the inverting 64 and non-inverting 66 input terminals and the output terminal 68 and to permit normal operation of the amplifier 52.

More particularly, due to the inclusion of the start-up circuit 54 in the amplifier 52, the output terminal 68 provides a start-up current to provide current to both PEP bipolar junction transistors (BATS) 60 and 62 of the bandgap reference circuit 50 during the powering up of the circuit 50. Therefore, as a result of the current that is provided by the output terminal 68, currents develop in the collector-emitter paths of the BATS 60 and 62 to cause the voltages of the input terminals 64 and 66 to rise.

As discussed below, in some embodiments of the invention, the start-up circuit 54 causes the Vbg voltage to rise to a logic one voltage level. In response to the Vbg voltage rising to this level, the voltages on the input terminals of the amplifier 52 rise. Therefore, at the completion of the powerup, the Vbg voltage has a nonzero voltage so that the Vbg voltage rises to a nonzero regulated bandgap voltage level instead of otherwise remaining at zero volts.

The advantages of the above-described arrangement may include one or more of the following. The start-up circuit 54 consumed only minimal power during the normal mode of operation of the amplifier 52 and bandgap reference circuit 50. Furthermore, current is provided to both BATS 60 and 62 during the powering up of the circuit 50, a design that permits a smaller input voltage range for the amplifier 52, as compared to the case in which current is provided to only one BJT of a bandgap reference circuit during the powering up of the circuit. Other and different advantages may be possible.

Figure 4:
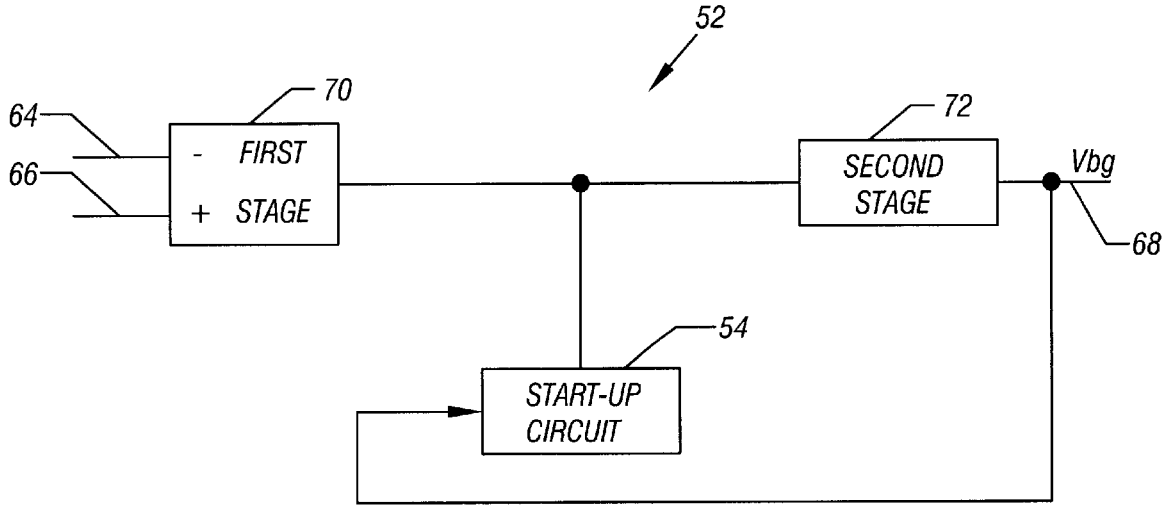
FIG. 4 is a schematic diagram of the amplifier of FIG. 3 according to an embodiment of the invention.

Referring to FIG. 4, in some embodiments of the invention, the amplifier 52 may include a first stage 70, a second stage 72 and the start-up circuit 54. The amplifier 52 may include additional stages, in other embodiments of the invention. During the normal mode of operation, the first stage 70 receives a differential input voltage (via the inverting 64 and non-inverting 66 input terminals) and generates a voltage that the second stage 72 amplifies to produce the Vbg voltage. In response to the amplifier 52 (and bandgap reference circuit 50) powering up, the start-up circuit 54 pulls the output terminal of the first stage 70 and the input terminal of the second stage 72 to ground, thereby disabling communication between the first 70 and second 72 stages. As described in more detail below, when the input terminal of the second stage 72 is pulled to ground, the second stage 72 is biased to provide an output current (via the output terminal 68) to the circuitry of the bandgap reference circuit 50. In response to the bandgap reference circuit 50 (and amplifier 52) powering up and entering the normal mode of operation, the start-up circuit 54 becomes disabled and permits communication between the first 70 and second 72 stages. Thus, during the normal mode of operation, the start-up circuit 54 does not affect operation of the amplifier 52 or bandgap reference circuit 50.

In the context of this application, the "powering up" of the bandgap reference circuit 50 refers to the mode of operation in which the bandgap reference circuit 50 transitions from a powered down state (i.e., a state in which the circuit 50 is powered off) to a state in which the Vbg bandgap voltage reaches a predetermined voltage level. This predetermined voltage level may or may not be the final regulated bandgap reference voltage level, depending on the particular embodiment of the invention. Similarly, the "powering up" of the amplifier 52 refers to the mode of operation in which the amplifier 52 transitions from a powered down state (i.e., a state in which the amplifier 52 is powered off) to a state in which the voltage on its output terminal 68 reaches a predetermined voltage level. This predetermined voltage level may or may not be the final regulated bandgap reference voltage level, depending on the particular embodiment of the invention. At the completion of the powering up, the bandgap reference circuit 50 and the amplifier 52 enter their normal modes of the operation, and the start-up circuit 54 is disabled.

Figure 5:
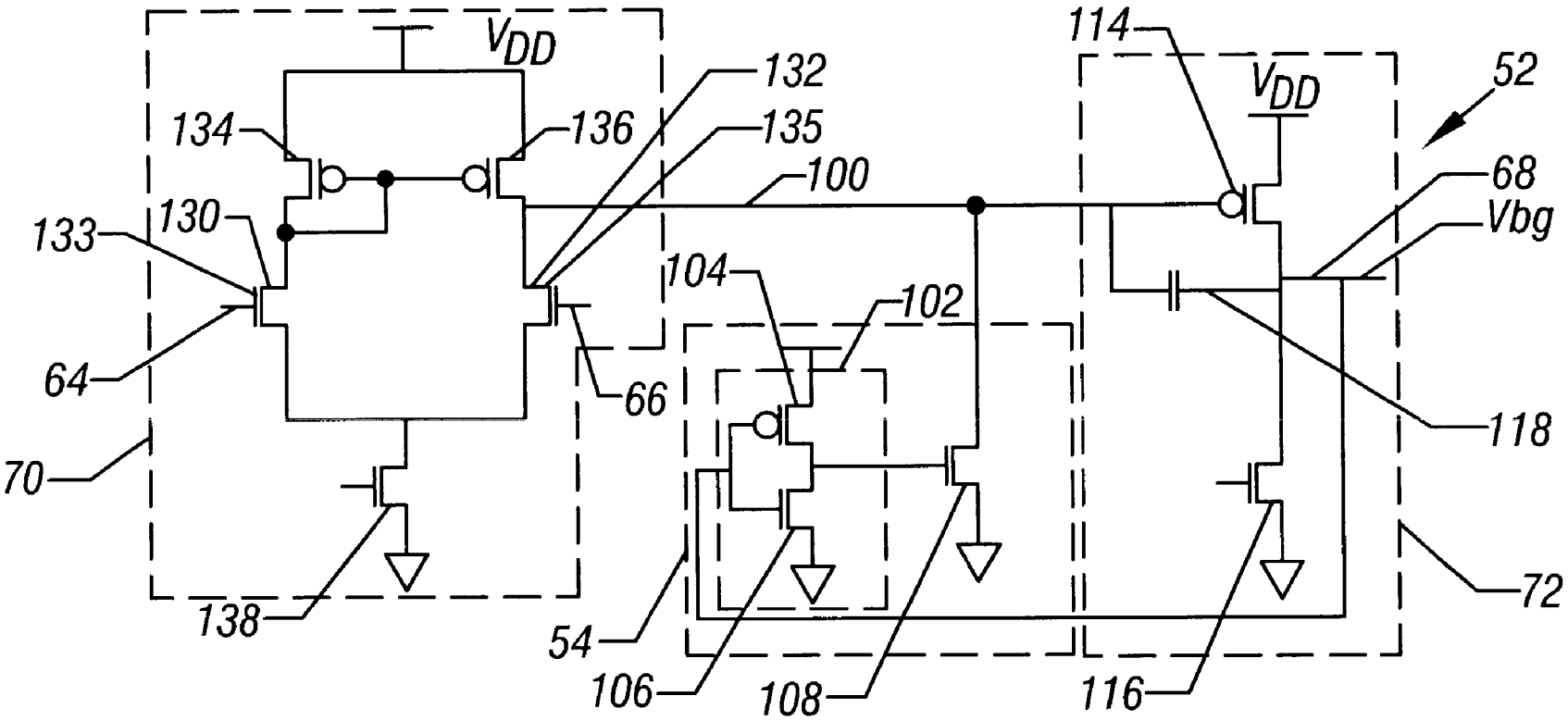
FIG. 5 is a more detailed schematic diagram of the amplifier of FIG. 4 according to an embodiment of the invention.

FIG. 5 depicts a more detailed schematic diagram of the amplifier 52. As shown, in some embodiments of the invention, the first stage 70 may be a differential amplifier stage, and the second stage 72 may be a common source amplifier stage. A node 100 of the amplifier 52 serves as both the output terminal of the first stage 70 and the input terminal of the second stage 72.

The start-up circuit 54 includes an n-channel metal-oxide-semiconductor field-effect-transistor (NMOSFET) 108 that is coupled to the node 100. The NMOSFET 108 pulls the node 100 to ground during the powering up of the amplifier 52 (and bandgap reference circuit 50). This coupling to ground, in turn, disables communication between the first stage 70 and the second stage 72. The drain terminal of the NMOSFET 108 is coupled to the node 100, the source terminal of the NMOSFET 108 is coupled to ground, and the gate terminal of the NMOSFET 108 receives a control voltage from an inverting amplifier 102. The inverting amplifier 102, in turn, receives the Vbg voltage and inverts this voltage to generate the control voltage to control operation of the NMOSFET 108. Therefore, in some embodiments of the invention, when the Vbg voltage is between zero volts and a predetermined logic one voltage threshold level during the powering up of the amplifier 52 (and bandgap reference circuit 50), the inverting amplifier 102 produces a logic one voltage on the gate terminal of the NMOSFET 108. This logic one voltage, in turn, causes the NMOSFET 108 to conduct and pull the node 100 to ground, thereby disabling communication between the first 70 and second 72 stages. However, when the Vbg voltage exceeds the predetermined logic one voltage threshold, the inverting amplifier 102 furnishes a logic zero voltage to the gate terminal of the NMOSFET 108 to cause the NMOSFET 108 to no longer conduct. Thus, this non-conduction decouples the startup circuit 54 from the node 100, thereby allowing communication between the first 70 and second 72 stages and normal operation of the amplifier 52 (and bandgap reference circuit 50).

Although the node 100 is grounded during the powering up, the second stage 72 is biased to produce a current (at the output terminal 68) that flows to the circuitry of the bandgap circuit 50, as described above. In some embodiments of the invention, the second stage 72 may be a common source amplifier stage that is formed from a p-channel MOSFET (PMOSFET) 114 and a biasing NMOSFET 116. The source terminal of the PMOSFET 114 is coupled to a supply voltage (called VDD), and the drain terminal of the PMOSFET 114 is coupled to the drain terminal of the NMOSFET 116 to form the output terminal 68. A Miller compensation capacitor 118 may be coupled between the gate and drain terminals of the PMOSFET 114. The gate terminal of the PMOSFET 114 is coupled to the node 100.

Thus, due to this arrangement, when the start-up circuit 54 pulls the node 100 to ground, the PMOSFET 114 is fully saturated to conduct and furnish current to the circuitry of the bandgap reference circuit 50. When the start-up circuit 54 no longer controls the node 100 during the normal mode of operation, the PMOSFET 114 is biased by the first stage 70 to conduct and amplify the signal present at its gate terminal to produce an amplified signal at the output terminal 68.

In some embodiments of the invention, the first stage 70 may be a differential amplifier stage that includes matched NMOSFETs 133 and 135 that each have their source terminals coupled to the drain terminal of an NMOSFET 138 that provides a biasing current. The gate terminals of the NMOSFETs 133 and 135 form the inverting 64 and non-inverting 66 input terminals, respectively, of the amplifier 52. The source terminal of the NMOSFET 138 is coupled to ground. The drain terminal of the NMOSFET 133 is coupled to the gate and drain terminals of a PMOSFET 134. The source terminal of the PMOSFET 134 is coupled to the VDD voltage supply. The gate terminal of the PMOSFET 134 is coupled to its drain terminal and is also coupled to the gate terminal of a mirroring PMOSFET 136, a transistor that has its source terminal coupled to the VDD supply voltage. The drain terminals of the NMOSFET 136 and 135 are coupled to the node 100.

In some embodiments of the invention, the inverting amplifier 102 of the start-up circuit 54 includes a PMOSFET 104 that has its drain terminal coupled to the gate terminal of the NMOSFET 108. The drain terminal of the PMOSFET 104 is also coupled to the drain terminal of an NMOSFET 106 of the amplifier 102. The source terminal of the NMOSFET 106 is coupled to ground, and the gate terminal of the NMOSFET 106 is coupled to the gate terminal of the PMOSFET 104. Both the gate terminals of the NMOSFET 106 and the PMOSFET 104 are coupled to the output terminal 68. Due to this configuration, when the Vbg voltage is below the predetermined logic one voltage level threshold, the NMOSFET 106 does not conduct. However, the PMOSFET 104 conducts to pull the gate terminal of the NMOSFET 108 to a logic one voltage level to cause the NMOSFET 108 to conduct. When the Vbg voltage rises above the logic one voltage threshold, the PMOSFET 108 no longer conducts but the NMOSFET 106 does conduct to pull the gate terminal of the NMOSFET 108 to ground to cause the NMOSFET 108 to no longer conduct.

Referring back to FIG. 3, besides the amplifier 52 and BATS 60 and 62, the bandgap reference circuit 50 may have the following additional circuitry. In this manner, the bandgap reference circuit 50 may include a resistor 58 that is coupled between the output terminal 68 and the inverting input terminal 64. A resistor 59 may be coupled between the inverting input terminal 64 and the emitter terminal of the BJT 60. The base and collector terminals of the BJT 60 may be coupled to ground. The bandgap reference circuit 50 may also include a resistor 56 that is coupled between the output terminal 68 and the non-inverting input terminal 66. The emitter terminal of the BJT 62 may also be coupled to the non-inverting input terminal 66, and the base and collector terminals of the BJT 62 may be coupled to ground. During its normal mode of operation the Vbg approximately follows the relationship that is described in Equation 3 above, assuming that the resistances of the resistors 56 and 58 are the same. The resistances of the resistors 56, 58 and 59 and the relative areas of the BATS 60 and 62 may be adjusted to obtain the desired regulated bandgap voltage level, as can be appreciated by those skilled in the art.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A bandgap reference circuit comprising:

at least one transistor;

an amplifier coupled to said at least one transistor to establish a bandgap reference voltage, the amplifier comprising an output terminal and at least one input terminal; and a startup circuit to, in response to a voltage on the output terminal indicating that the bandgap reference circuit is powering up, isolate the output terminal from said at least one input terminal and supply power to said at least one transistor via the output terminal.

2. The bandgap reference circuit of claim 1, wherein the startup circuit permits communication between said at least one input terminal of the amplifier and the output terminal of the amplifier in response to the bandgap reference circuit reaching completion of the powering up.

3. The bandgap reference circuit of claim 1, wherein the startup circuit establishes a predetermined voltage level on at least one of said input terminals.

4. The bandgap reference circuit of claim 1, wherein the amplifier comprises:

a first stage coupled to said at least one input terminal; and a second stage coupled to the output terminal, wherein the startup circuit controls communication between the first and second stages.

5. The bandgap reference circuit of claim 4, wherein the amplifier isolates the first and second stages in response to the powering up.

6. The bandgap reference circuit of claim 4, wherein the amplifier causes the second stage to furnish current to the output terminal in response to the powering up.

7. The bandgap reference circuit of claim 4, wherein the amplifier biases the second stage in response to the powering up.

8. The bandgap reference circuit of claim 4, wherein the first stage comprises a differential stage.

9. The bandgap reference circuit of claim 4, wherein the second stage comprises a common source stage.

10. The bandgap reference circuit of claim 1, wherein the start-up circuit is part of the amplifier.

11. The bandgap reference circuit of claim 1, wherein the output terminal provides an output voltage, and said at least one transistor comprises first and second bipolar junction transistors coupled to receive currents produced in response to the output voltage.

12. The bandgap reference circuit of claim 11, wherein the output voltage comprises a bandgap reference voltage.

13. An amplifier comprising:

at least one input terminal;

an output terminal; and a startup circuit to, in response to a voltage on the output terminal indicating that the amplifier is powering up, isolate the output terminal from said at least input terminal and provide power to the output terminal.

14. The amplifier of claim 13, wherein the startup circuit permits communication between said at least one input terminal and the output terminal in response to the completion of the powering up.

15. The amplifier of claim 13, wherein the startup circuit isolates the first and second stages in response to the powering up.

16. The amplifier of claim 13, wherein the startup circuit causes the second stage to furnish current to the output terminal in response to the powering up.

17. The amplifier of claim 13, wherein the startup circuit biases the second stage in response to the powering up.

18. The amplifier of claim 13, wherein the first stage comprises a differential amplifier stage.

19. The amplifier of claim 13, wherein the second stage comprises a common source amplifier stage.

20. The amplifier of claim 13, wherein the output terminal provides a bandgap reference voltage.

21. A method comprising:

in response to an amplifier powering up, amplifying a first signal indicated by at least one input terminal to produce a second signal at an output terminal of the amplifier;

monitoring a voltage on the output terminal; and in response to the voltage on the output terminal indicating that the amplifier is powering up, isolating the output terminal from said at least one input terminal and providing power to the output terminal.

22. The method of claim 21, further comprising:

permitting communication between said at least one input terminal and the output terminal in response to the amplifier completing the powering up.

23. The method of claim 21, wherein providing power comprises:

establishing a predetermined voltage level on at least one of said at least one input terminal.

24. The method of claim 21, wherein the isolating comprises isolating communication between first and second stages of the amplifier.

25. The method of claim 21, further comprising:

biasing a stage of the amplifier in response to the powering up.

* * * * *